US011634845B2

(12) United States Patent
Belda Navarro et al.

(10) Patent No.: US 11,634,845 B2
(45) Date of Patent: Apr. 25, 2023

(54) QUILTING MACHINE FOR FABRICS

(71) Applicant: IMASD S.L., Ontinyent (ES)

(72) Inventors: Sergio Belda Navarro, Ontinyent (ES); Jose Vicente Albero Navarro, Ontinyent (ES)

(73) Assignee: IMASD S.L., Ontinyent (ES)

( * ) Notice: Subject to any disclaimer, the term of this patent is extended or adjusted under 35 U.S.C. 154(b) by 36 days.

(21) Appl. No.: 17/604,856

(22) PCT Filed: May 7, 2020

(86) PCT No.: PCT/ES2020/070291
§ 371 (c)(1),
(2) Date: Oct. 19, 2021

(87) PCT Pub. No.: WO2020/229715
PCT Pub. Date: Nov. 19, 2020

(65) Prior Publication Data

US 2022/0220649 A1 Jul. 14, 2022

(30) Foreign Application Priority Data

May 16, 2019 (ES) ..... ES201930824U

(51) Int. Cl.
*D05B 11/00* (2006.01)
*D05B 19/14* (2006.01)
(Continued)

(52) U.S. Cl.
CPC ..... *D05B 11/00* (2013.01); *D05B 19/14* (2013.01); *D05B 19/16* (2013.01); *D05B 27/16* (2013.01)

(58) Field of Classification Search
CPC ..... D05B 11/00; D05B 19/14; D05B 19/16; D05B 27/16; D05B 69/00–04; D05B 69/14–18
See application file for complete search history.

(56) References Cited

U.S. PATENT DOCUMENTS 2,505,822 A * 5/1950 Bechik ..... D05B 11/00 112/470.12
3,465,697 A * 9/1969 Gerlach ..... D05B 11/00 112/118

(Continued)

FOREIGN PATENT DOCUMENTS

CN 105177866 A 12/2015
CN 106809794 A 6/2017

OTHER PUBLICATIONS

Transcription of D05 Acolchadora CLEVTRON. Mar. 28, 2017 [on line] [retrieved the Nov. 7, 2020]. Retrieved from <URL: https://www.youtube.com/watch?v=vTyEdiXnHZM>.

(Continued)

*Primary Examiner* — Ismael Izaguirre
(74) *Attorney, Agent, or Firm* — Collard & Roe, P.C.

(57) ABSTRACT

The invention relates to a quilting machine for fabrics, including at least three pairs of drive rollers between which the fabric can pass, one pair of rollers being the master pair and the other pairs of rollers being the slave pairs, generating a sewing area and a post-sewing area. Each pair of rollers consists of two opposing rollers associated with a set of chains and sprockets allowing the rollers to rotate in opposite directions to one another. The machine also includes pneumatic cylinders, associated with the pairs of drive rollers, for varying the distance between paired rollers, stabiliser bars for maintaining paired rollers parallel to one another, a sewing head, and a controller for controlling all of the pairs of drive rollers and the sewing head independently, exerting tension on the fabric in the sewing and post-sewing areas.

11 Claims, 4 Drawing Sheets

(51) Int. Cl.
*D05B 19/16* (2006.01)
*D05B 27/16* (2006.01)

(56) References Cited

U.S. PATENT DOCUMENTS

| | | | | | |
|---|---|---|---|---|---|
| 3,583,340 | A * | 6/1971 | Dahl | B23Q 35/16 | 112/118 |
| 4,061,096 | A * | 12/1977 | Elsas | D05B 11/00 | 112/155 |
| 4,501,208 | A * | 2/1985 | Landoni | D05B 11/00 | 112/102 |
| 7,735,439 | B1 * | 6/2010 | Price | D05B 11/00 | 112/117 |
| 2005/0178307 | A1 | 8/2005 | Frazer et al. | | |
| 2009/0064911 | A1 | 3/2009 | Oxley et al. | | |
| 2018/0327950 | A1 * | 11/2018 | James | D05B 11/00 | |

OTHER PUBLICATIONS

International Search Report of PCT/ES2020/070291, dated Jul. 23, 2020.

* cited by examiner

QUILTING MACHINE FOR FABRICS

CROSS REFERENCE TO RELATED APPLICATIONS

This application is the National Stage of PCT/ES2020/070291 filed on May 7, 2020, which claims priority under 35 U.S.C. § 119 of Spanish Application No. U201930824 filed on May 16, 2019, the disclosure of which is incorporated by reference. The international application under PCT article 21(2) was not published in English.

OBJECT OF THE INVENTION

The present invention relates to a quilting machine for fabrics of the type used in manufacturing cushions, duvets, and the like. The machine object of the invention incorporates a plurality of pairs of drive rollers in charge of moving the fabric along the machine so it can be sewn in both directions of forward movement, one of the pairs of rollers being the master pair and the rest being slave pairs of the mentioned master pair. The master and slave pairs of rollers thereby work in a synchronised manner under the orders of a controller to give rise to the desired sewing pattern.

The object of the invention is to provide a quilting machine which enables the optimum level of tension required in each area of the machine, resulting in an accurate, precise, and crease-free sewing pattern in the fabric.

BACKGROUND OF THE INVENTION

The machines for sewing one or more layers of cloth, commonly known as quilting machines, are pieces of equipment used in making fabrics such as those commonly used in the manufacture of cushions, duvets, and the like. These machines commonly consist, among other elements, of a series of rollers on which the fabric to be sewn is arranged and one or more sewing heads executing a sewing pattern on the fabric as it moves forward through the machine.

However, known quilting machines do not allow a sewing pattern to be executed with precision and uniformity along the fabric, which leads to irregularities at the ends of the fabric and creasing in those sewing patterns that require the fabric to move forward and backward successively during the sewing operation.

Additionally, quilting machines having fixing means for holding the fabric in a stationary position while a sewing head moves across its surface giving rise to a sewing pattern are known in the state of the art. Quilting machines of this type have a long operating cycle and are, therefore, not cost-effective when working in large volumes.

In that sense, the applicant of the present utility model detects the need to solve the problems discussed above by means of an innovative and efficient solution which enables fabric to be sewn efficiently as a result of the precise control of the tension applied on the fabric to be sewn in each area of the machine, enabling it to move forward or backward through the quilting machine.

DESCRIPTION OF THE INVENTION

The quilting machine object of the present invention allows the drawbacks discussed above to be solved, which enables a quilted fabric to be obtained in which the sewing pattern is executed with precision and uniformity, preventing unwanted irregularities and creasing on the fabric.

The proposed quilting machine has the following components:

- At least three pairs of drive rollers, between which the fabric to be sewn can tightly pass. Each of these pairs consists of two opposing rollers, preferably a fixed roller and a moving roller, associated with a set of chains and sprockets allowing the rollers to rotate in opposite directions to one another, so that the fabric can move through the quilting machine. Each pair of drive rollers is linked to a servomotor with a gear reducer and a variable speed drive.
- A controller associated with each of the variable speed drives and servomotors for controlling all of the pairs of drive rollers and the sewing heads independently and simultaneously, determining the speed and degree of rotation of each of the pairs of drive rollers. Therefore, the controller allows a predetermined sewing pattern to be executed with accuracy, transmitting the necessary orders to the variable speed drives and servomotors for a pair of drive rollers to be the master pair, executing the sewing pattern on the fabric, and the remaining pairs of drive rollers to be slave pairs, synchronised with the movement of the master pair, making the fabric move forward or backward through the machine to give rise to the desired sewing pattern. The slave pairs of rollers drive the fabric and apply tension on same, with a sewing area before the master pair and a post-sewing area after the master pair being distinguished. Advantageously, the tension applied on the fabric by the pairs of rollers prevents creasing on said fabric, creating a precise and irregularity-free sewing pattern, since the master pair of rollers always receives fabric under tension, regardless of the direction of forward movement of the fabric in the machine.
- Pneumatic cylinders associated with the pairs of drive rollers at each of their ends, which allow the distance between paired rollers, and therefore the pressure applied on the fabric, to be selected.
- Stabiliser bars linked to each of the pairs of drive rollers for maintaining paired rollers parallel to one another, preventing the fabric from being subjected to greater pressure by the rollers at one end of the machine than at the other end, so the tension applied on the fabric to be quilted is maintained uniform across its entire width, assuring precision and accuracy of the sewing pattern.
- At least one independent sewing head arranged in the sewing area for sewing the fabric. The sewing head moves in a perpendicular direction relative to the direction of movement of the fabric in the machine, giving rise to the sewing pattern.

Optionally, the quilting machine object of the present invention has two additional pairs of drive rollers, referred to as feed and removal rollers, arranged before and after the slave pairs of rollers, which are linked to stabiliser bars and pneumatic cylinders which perform the same function as those described above for the master and slave pairs of rollers. Therefore, a pair of feed drive rollers introduces the unsewn fabric in the machine, generating an accumulation area of the fabric before the sewing area, in which tension is not applied on the fabric.

Advantageously, the accumulation area before the sewing area isolates the fabric to be sewn from external factors before the quilting machine, such as fabric production and treatment processes prior to the quilting phase, which prevents having to change the subsequent sewing operation in the quilting machine. In order to determine the length of fabric present in the accumulation area, optionally, there will be incorporated a sensor for measuring the linear length in the accumulation area, which sensor transmits the value of length measured to the controller so that it can act on the pair of feed drive rollers, varying their speed and degree of rotation to store the desired amount of fabric in the accumulation area before the sewing area.

In a similar manner, there will optionally be incorporated a pair of removal drive rollers driving the sewn fabric for it to be removed from the machine, generating an accumulation area of sewn fabric after the post-sewing area, thereby isolating the sewn fabric from external conditions after the quilting machine, preventing them from influencing the sewing operation. Optionally, a sensor for measuring the linear length of fabric is in charge of determining the length of fabric present in the accumulation area after the post-sewing area, transmitting the value of length measured to the controller so that it can act on the pair of drive rollers driving the sewn fabric, varying their speed and degree of rotation to accumulate the desired amount of fabric after the post-sewing area.

To enable a large radius of curvature of the fabric at the inlet and outlet of the machine, the quilting machine comprises at least one free roller before the sewing area and at least one free roller after the post-sewing area.

Finally, each of the rollers of the quilting machine is optionally covered with rubber or a similar material in order to increase the friction coefficient between the roller and the fabric, facilitating the movement of the fabric though the machine and minimising damages on its surface.

In summary, the configuration of the quilting machine described enables a precise sewing pattern to be obtained, minimising defects, creasing, and irregularities in the fabric, as a result of the control of the tension applied at all times on said fabric, and of the coordinated action of the master and slave pairs of drive rollers, which allow the fabric to move forward through the quilting machine in both directions, being adapted to the requirements of the sewing pattern or of the production process itself.

DESCRIPTION OF THE DRAWINGS

To complement the description that will be made below and for the purpose of helping to better understand the features of the invention according to a preferred practical embodiment thereof, a set of drawings is attached as an integral part of said description, in which the following is depicted in an illustrative and non-limiting manner.

PREFERRED EMBODIMENT OF THE INVENTION

Figure 1:
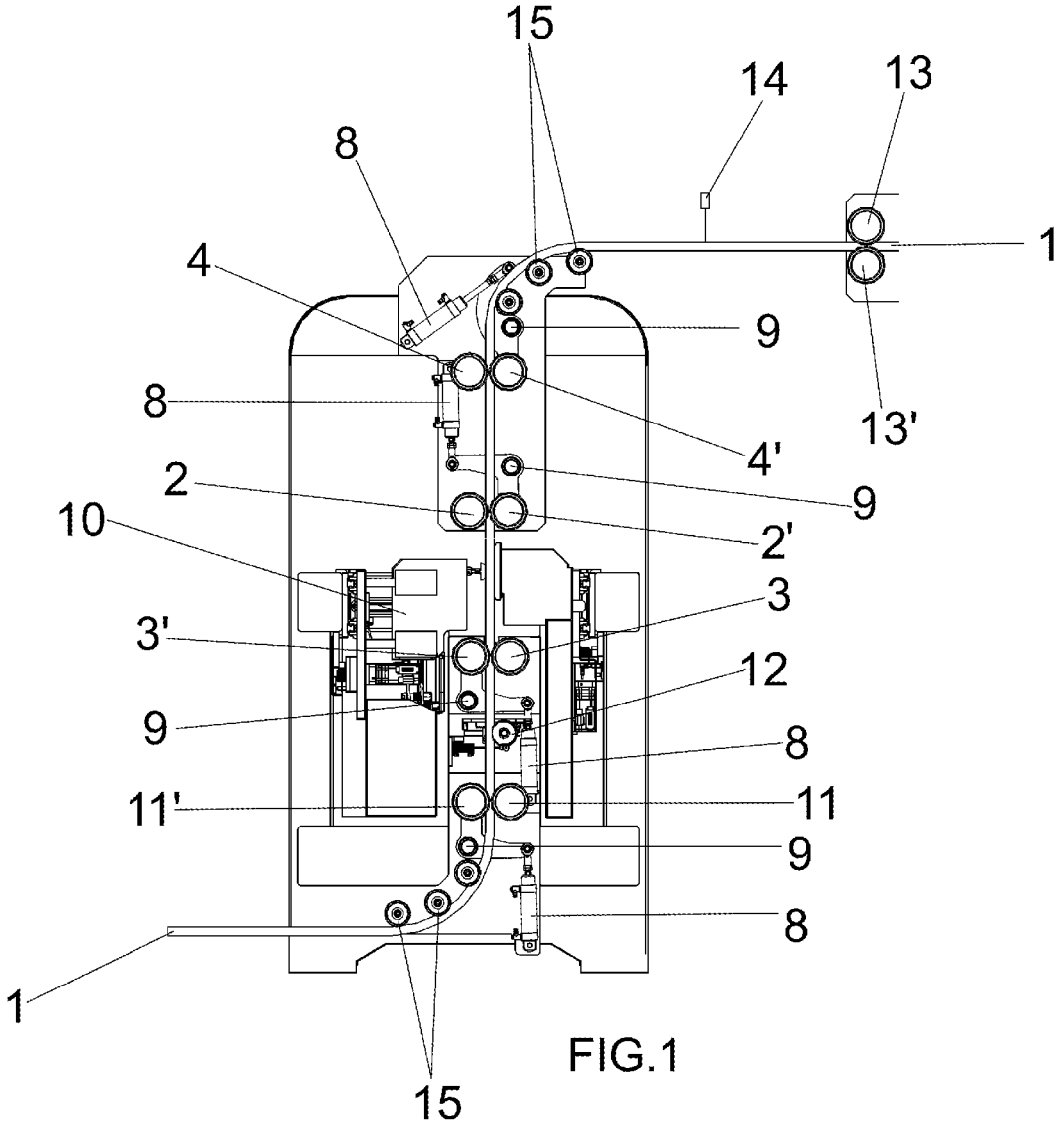
FIG. 1 shows a depiction corresponding to the cross-section of a quilting machine and the fabric to be sewn according to the object of the present invention.
Figure 2:
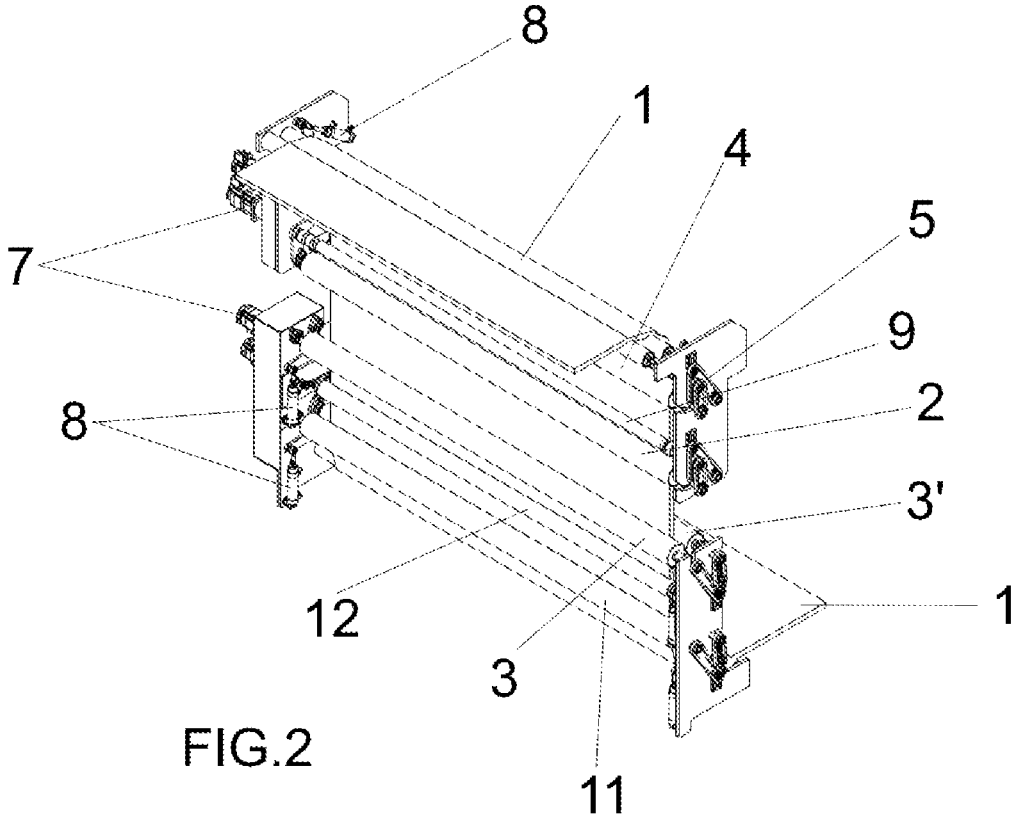
FIG. 2 shows a partial depiction of a perspective view of the rear part of the quilting machine.
Figure 4:
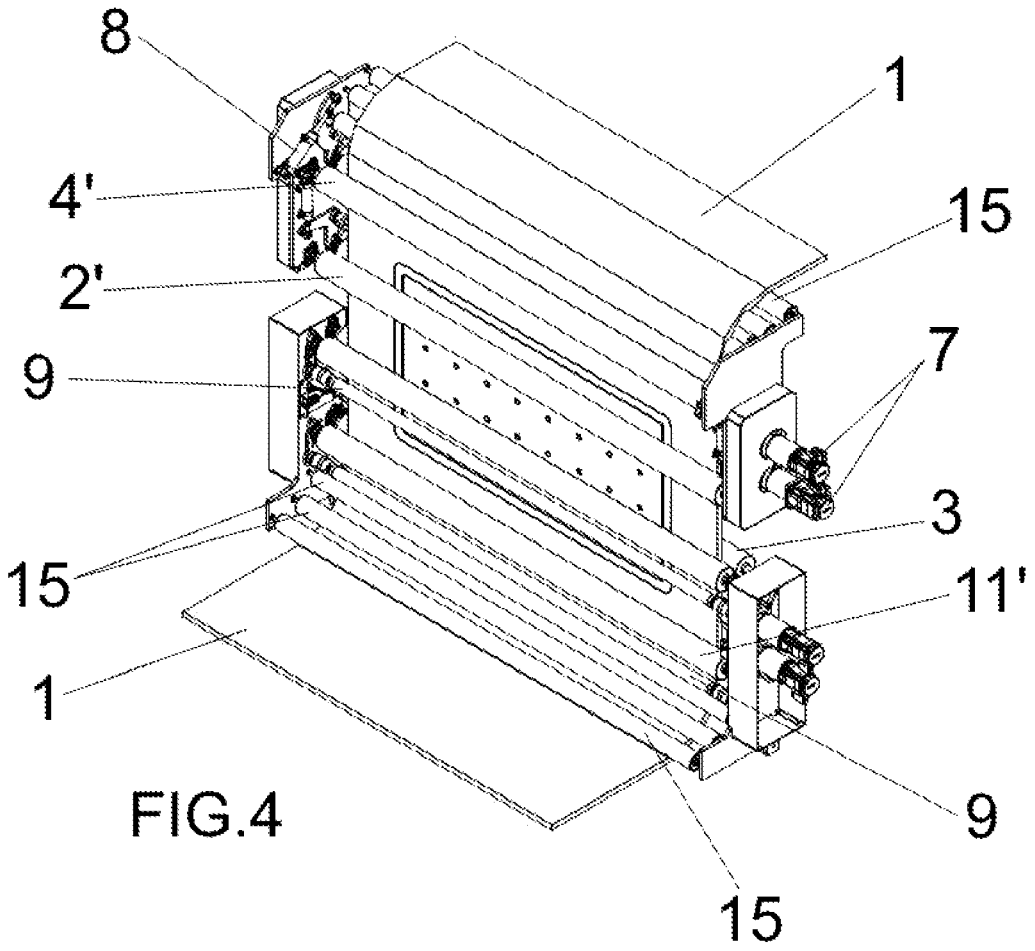
FIG. 4 shows a partial depiction of a perspective view of the front part of the quilting machine.

As can be seen in FIGS. 1, 2, and 4, in the present preferred embodiment the quilting machine comprises five pairs of drive rollers, between which a fabric (1), formed by two outer layers and one or more intermediate layers of padding, tightly passes. Each of the rollers making up the pair rotates in the opposite direction to the other roller, driving the fabric (1) and enabling it to move forward or backward through the quilting machine. The rollers (2), (3), (4), (11), and (13) are fixed and linked to a servomotor (7) with a gear reducer and variable speed drive, as observed in FIGS. 2 and 4, whereas the rollers (2'), (3'), (4'), (11'), and (13') are movable. Pneumatic cylinders (8) linked to each pair of rollers at each of their ends allow varying the distance between paired rollers, therefore varying the pressure applied on the fabric (1).

Figure 3:
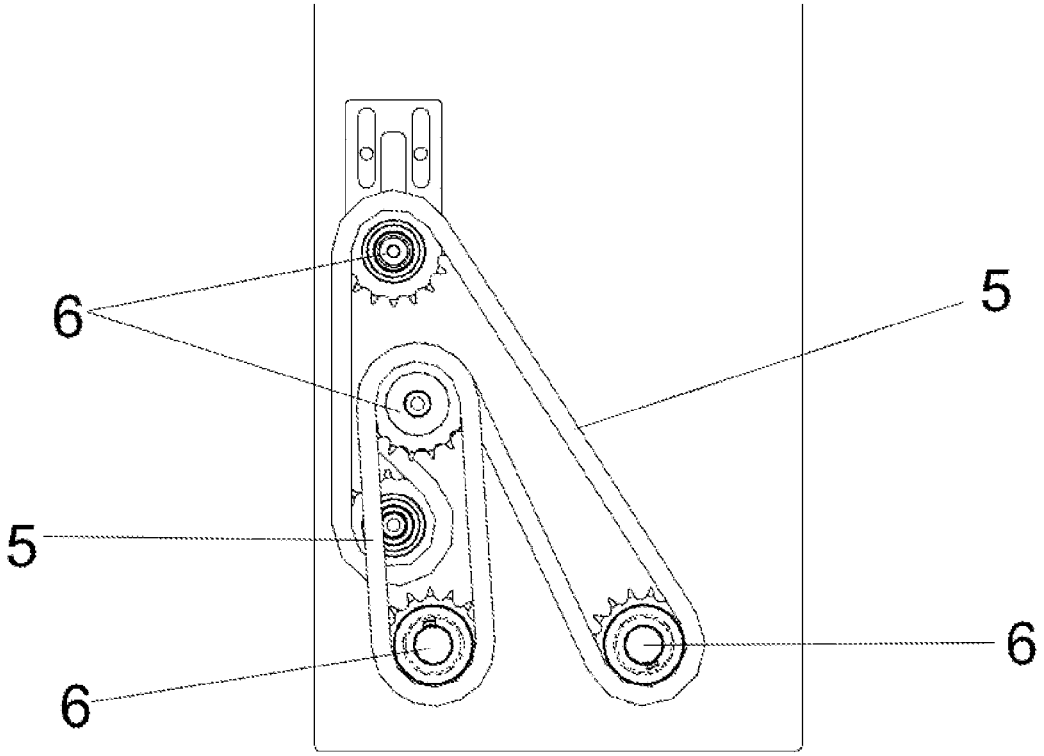
FIG. 3 shows a schematic depiction of the detail of the set of chains and sprockets in charge of transmitting movement between the rollers making up each of the pairs.

FIGS. 2 and 3 show in detail a set of chains (5) and sprockets (6) in charge of transmitting movement from the fixed rollers, rollers (2), (3), (4), (11), and (13), to the movable rollers (2'), (3'), (4'), (11'), and (13').

In one of the operating modes of the quilting machine, the unsewn fabric (1) is introduced through its lower part, moving forward vertically through said machine, as observed in FIGS. 1, 2, and 4. Three free rollers (15) guide the travel of the fabric (1) increasing its radius of curvature, facilitating a smooth entry into the machine, whereas the fabric (1) is driven by the pair of feed rollers (11), (11'), generating an accumulation area of the fabric (1). As described in detail above, the accumulation area allows the sewing operation to be isolated from external conditions before the quilting machine. A sensor (12) for measuring the linear length of the fabric, preferably a sensor roller, determines the amount of fabric (1) present in the accumulation area, which information is transmitted to the controller to regulate the speed and degree of rotation of the feed rollers (11), (11').

Then, a slave pair of drive rollers (3), (3') drive the fabric (1), introducing it into the sewing area where one or more sewing heads (10), up to a maximum of 8 sewing heads, execute the sewing operation. The sewing heads (10) move laterally and independently, whereas the fabric (1) moves forward vertically in both directions of forward movement, giving rise to the sewing pattern. Advantageously, the use of a plurality of sewing heads allows production speed to increase.

Next, the sewn fabric (1) is driven by the master pair of drive rollers (2), (2'), entering the post-sewing area due to the drive exerted by the slave pair of rollers (4), (4').

Therefore, the slave pairs of drive rollers (3), (3') and (4), (4') apply a maximum tension of 2000 N on the fabric (1) in the sewing and post-sewing areas, so the master pair of rollers (2), (2') receives at all times tensed fabric, assuring the precision and correct execution of the predetermined sewing pattern, preventing creasing in the cloth during the forward and backward movement of the fabric (1).

Advantageously, as described in detail above, a controller governs all of the pairs of rollers simultaneously, such that the master pair of rollers, (2), (2') executes the sewing pattern, and the slave pairs of rollers, (3), (3'), (4), (4') drive and tauten the fabric (1) in synchronisation with the actuation of the master pair (2), (2').

On the other hand, a pair of removal drive rollers (13), (13') drives the sewn fabric (1), after passing through three free rollers (15) which increase the radius of curvature of the sewn fabric (1), generating an accumulation area at the outlet of the quilting machine, in which minimum tension is applied on the fabric (1), and which allows the sewing operation to be isolated from factors external to the operation after the quilting machine. In this accumulation area there is arranged a sensor (14) for measuring the linear length of fabric (1), preferably a distance sensor, in charge of transmitting to the controller information relative to the amount of fabric (1) accumulated in the mentioned area, for the regulation of the pair of drive rollers (13), (13') driving the sewn fabric (1).

As can be observed in the mentioned figures, each pair of drive rollers is linked to a stabiliser bar (9), which maintains a parallel position between paired rollers, preventing the fabric (1) from being subjected to greater pressure at one end of the machine that at the other, which results in the quality of the executed sewing pattern.

Advantageously, the configuration described above enables the controller to act on the different servomotors (7) and variable speed drives to move the fabric (1) in both directions, i.e., moving forward or backward through the quilting machine based on the predetermined sewing pattern and production needs.

The rollers making up each drive pair have a diameter between 75 and 200 mm, preferably 140 mm, and a wall thickness between 3 and 20 mm, preferably 8 mm. These dimensions cause the rollers to offer the stiffness needed to prevent vibrations and deformations in same.

Lastly, it should be pointed out that the drive rollers are covered with rubber or a similar material in order to increase the friction coefficient with the fabric (1) to be quilted and to facilitate the movement of the fabric and protect its surface.

The invention claimed is:

1. A quilting machine for fabrics comprising:

at least three pairs of drive rollers between which fabric (1) can pass, one pair of the rollers (2), (2') being a master pair and the rest being slave pairs of rollers (3), (3'), (4), (4') with respect to the master pair of rollers (2), (2'), arranged in such a way that the rollers generate a sewing area and a post-sewing area, and each pair of the rollers consists of two opposing rollers associated with a set of chains (5) and sprockets (6) allowing the rollers to rotate in opposite directions to one another, with each pair of drive rollers being linked to a servomotor (7) with a variable speed drive and gear reducer which modifies the speed and degree of rotation of the rollers, pneumatic cylinders (8) associated with the pairs of drive rollers and being configured for varying the distance between paired rollers, stabiliser bars (9) linked to each of the pairs of drive rollers and being configured for maintaining paired rollers parallel to one another, at least one independent sewing head (10) arranged in the sewing area, and a controller associated with each of the variable speed drives and servomotors and being configured (7) for controlling all of the pairs of drive rollers and the sewing head (10) independently and simultaneously, varying the speed and degree of rotation of the slave pairs of rollers (3), (3'), (4), (4') based on the master pair of rollers (2), (2') and exerting tension on the fabric in the sewing and post-sewing areas.

2. The quilting machine for fabrics according to claim 1, wherein the slave pairs of rollers (3), (3'), (4), (4') apply a maximum tension of 2000 N to the fabric (1) in the sewing and post-sewing areas.

3. The quilting machine for fabrics according to claim 1, wherein each pair of drive rollers consists of a fixed roller (2), (3), (4) and a movable roller (2'), (3'), (4'), with the fixed roller (2), (3), (4) being driven by the associated servomotor (7) which transmits movement to the movable roller (2'), (3'), (4') by means of the set of chains (5) and sprockets (6).

4. The quilting machine for fabrics according to claim 1, wherein each roller (2), (2'), (3), (3'), (4), (4') has a diameter between 75 and 200 mm.

5. The quilting machine for fabrics according to claim 1, wherein each roller (2), (2'), (3), (3'), (4), (4') has a wall thickness between 3 and 20 mm.

6. The quilting machine for fabrics according to claim 1, further comprising a pair of feed drive rollers (11), (11') associated with a pneumatic cylinder (8) and with a stabiliser bar (9), each roller of the pair of feed drive rollers having a diameter between 75 and 200 mm and a wall thickness between 3 and 20 mm, for introducing unsewn fabric (1) in the machine, generating an accumulation area of the fabric (1) before the sewing area.

7. The quilting machine for fabrics according to claim 6, further comprising a sensor (12) for measuring a linear length of fabric (1) in the accumulation area of the fabric (1) before the sewing area.

8. The quilting machine for fabrics according to claim 1, further comprising a pair of removal drive rollers (13), (13') configured for removing sewn fabric (1) associated with a pneumatic cylinder (8) and a stabiliser bar (9), each roller having a diameter between 75 and 200 mm and a wall thickness between 3 and 20 mm, for driving the sewn fabric (1) generating an accumulation area of sewn fabric (1) after the post-sewing area.

9. The quilting machine for fabrics according to claim 8, further comprising a sensor (14) for measuring a linear length of fabric (1) in the accumulation area of the fabric after the post-sewing area.

10. The quilting machine for fabrics according to claim 1, has further comprising at least one free roller (15) before the sewing area and at least one free roller (15) after the post-sewing area.

11. The quilting machine for fabrics according to claim 1, wherein each of the drive rollers (2), (2'), (3), (3'), (4), (4'), is covered with rubber.

* * * * *